US006854305B2

(12) United States Patent
Hurskainen et al.

(10) Patent No.: US 6,854,305 B2
(45) Date of Patent: Feb. 15, 2005

(54) ELECTROMECHANICAL CYLINDER LOCK-KEY-COMBINATION

(75) Inventors: Oiva Hurskainen, Joensuu (FI); Hannu Sivonen, Marjovaara (FI)

(73) Assignee: Abloy Oy, Joensuu (FI)

( * ) Notice: Subject to any disclaimer, the term of this patent is extended or adjusted under 35 U.S.C. 154(b) by 28 days.

(21) Appl. No.: 10/380,358

(22) PCT Filed: Sep. 27, 2001

(86) PCT No.: PCT/FI01/00841

§ 371 (c)(1),
(2), (4) Date: Mar. 13, 2003

(87) PCT Pub. No.: WO02/29188

PCT Pub. Date: Apr. 11, 2002

(65) Prior Publication Data

US 2004/0020253 A1 Feb. 5, 2004

(30) Foreign Application Priority Data

Oct. 5, 2000 (FI) ..... 20002191

(51) Int. Cl.[7] ..... E05B 29/04; E05B 47/00

(52) U.S. Cl. ..... 70/278.3; 70/278.7; 70/366; 70/422

(58) Field of Search ..... 70/495, 365, 366, 70/188, 189, 283.1, 222, 223, 422, 278.2, 278.3, 278.7, 279.1, 277, 278.6, 417, 453, 278.5

(56) References Cited

U.S. PATENT DOCUMENTS 4,956,984 A * 9/1990 Chi-Cheng ..... 70/277
5,447,047 A * 9/1995 Lin ..... 70/218
5,791,177 A * 8/1998 Bianco ..... 70/283.1
5,884,515 A * 3/1999 Milman ..... 70/472
6,155,089 A * 12/2000 Hurskainen et al. ..... 70/278.3

FOREIGN PATENT DOCUMENTS

| | | | |
|---|---|---|---|
| EP | 0 943 763 | 9/1999 | |
| FR | 2 687 426 | 8/1993 | |
| GB | 2178476 | * 2/1987 | ..... 70/278.3 |

* cited by examiner

*Primary Examiner*—Lloyd A. Gall
(74) *Attorney, Agent, or Firm*—Smith-Hill and Bedell

(57) ABSTRACT

An electromechanical cylinder lock-key-combination includes a key having a mechanical locking code and a device for storing an electronic code and sending it into the lock. A lock body encloses a turnable lock cylinder and a locking mechanism which normally prevents turning of the lock cylinder with regard to the lock body and which can be moved by the key into a releasing position allowing turning of the lock cylinder. The lock includes a special locking disc with which the key is not in direct mechanical force transmission connection, an identification and control device for receiving and identifying the electronic code from the key, and an electric operating device with a turnable coupling member attached thereto and having a free position and a coupling position in which it couples the special locking disc with the turning movement of the key for opening the lock, whereby when there is a match with the correct electronic code of the key the identification and control device activates the electric operating device to guide the coupling member to its coupling position. The coupling member is located and is in cooperation with a guiding groove in the special locking disc, the guiding groove having a guiding surface which the coupling member affects in its coupling position thereby turning the special locking disc when the key is turned in the lock.

15 Claims, 2 Drawing Sheets

Fig. 1
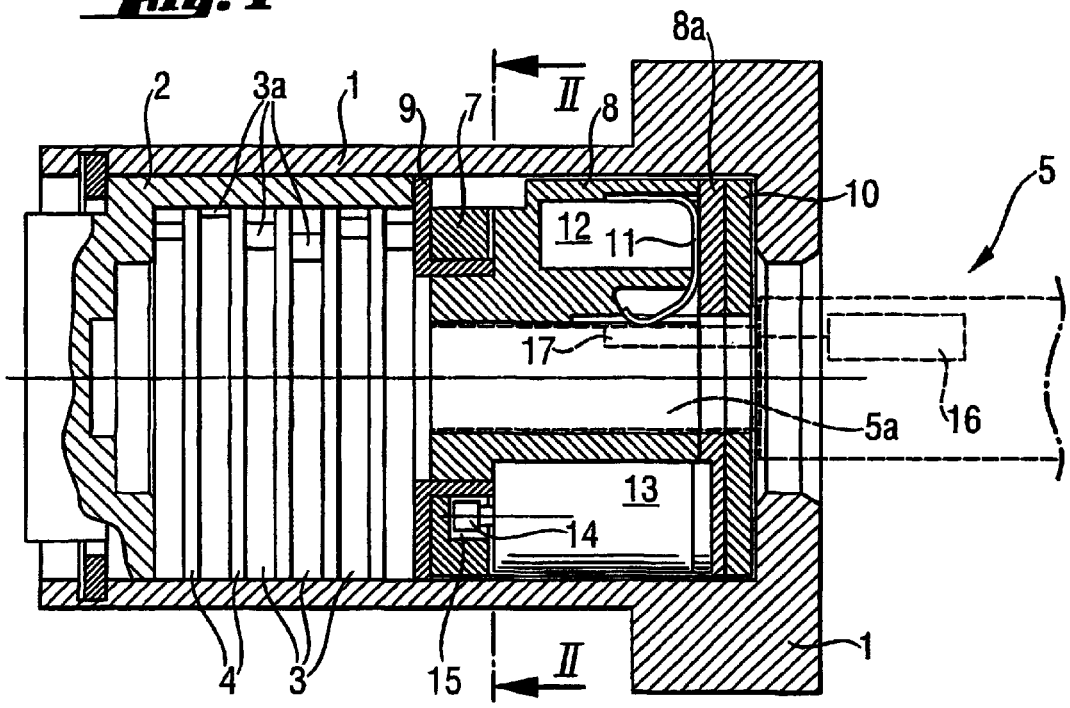
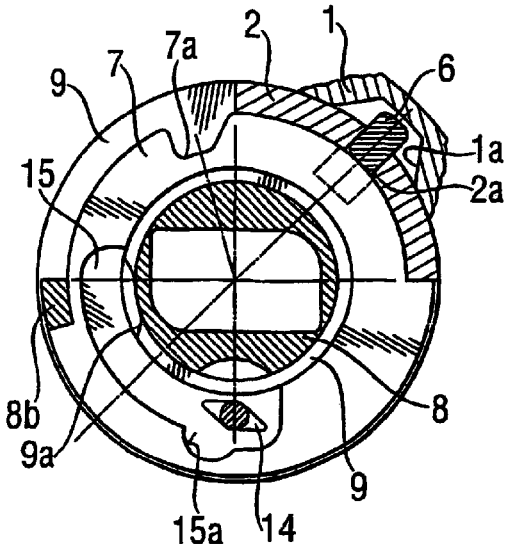
Fig. 2
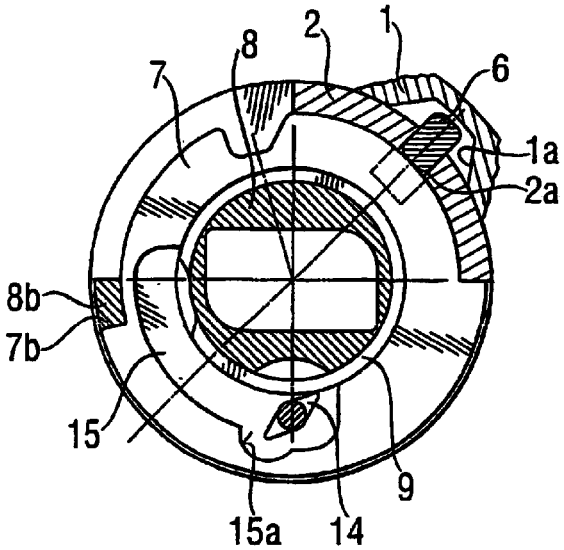
Fig. 3

ELECTROMECHANICAL CYLINDER LOCK-KEY-COMBINATION

BACKGROUND OF THE INVENTION

The invention relates to an electromechanical cylinder lock-key-combination.

In order to improve the security of locks there has been a shift from mechanical cylinder locks to electromechanical cylinder locks which have locking means which can be opened mechanically directly with the key of the lock or electronically by means of an electronic code supplied separately from a key or the like storing means. Numerous solutions are known in which the correct electronic code is arranged to influence a separate blocking means and either move it directly into a position releasing the lock cylinder or enable it to be moved into such a releasing position.

An alternative known type of electromechanical cylinder lock has conventional locking means and, in addition thereto, further locking means which cannot normally be operated by means of a mechanical key of the lock but which, as a consequence of a correct electronic code, can be separately coupled to become in force transmitting connection with the key of the lock for opening the lock. EP-A-0943763 discloses different embodiments of such known cylinder locks. These known mechanical coupling arrangements cannot, however, be easily implemented in present lock cylinders fulfilling certain norms because of their requirements for space. Also the reliability and implementation costs of the mechanisms have resulted in the need for further development.

An aim of the invention is to develop further the solutions and embodiments mentioned above and to provide an improved solution which, with regard to the mechanical implementation of the cylinder lock, is as simple, reliable and advantageous as to its costs as possible and which from the viewpoint of space requirements can with advantage also be implemented in cylinder locks currently in use.

SUMMARY OF THE INVENTION

The solution is simple and does not require members movable in the axial direction of the lock, but only turning movement is needed for a coupling member having minor mass. Such a movement can be accomplished with quite a small electric impulse.

The guiding groove is with advantage so designed that in the free or non-coupling position of the coupling member it allows turning movement of the key so that the special locking disc does not then turn together with the coupling member and the key. Since it is then not possible to affect the coupling member and the special locking disc directly with the key, it is not possible either, in case of an incorrect electronic code, to break the additional locking mechanism by applying force to the key.

Advantageously the lock body includes a control unit which is continuously turnable with the key and on which the electric operating means, the coupling member and preferably also the identification and control means are arranged, the control unit being partly located inside the lock cylinder. This arrangement is advantageous from the viewpoint of assembly and space requirements. When the control unit is only partly inside the lock cylinder, its diameter outside the lock cylinder can be the same as that of the lock cylinder itself.

With advantage the special locking disc is located inside the lock cylinder between, in the axial direction of the lock, the locking means and the control unit. Preferably the special locking disc is positioned radially outwardly of, so as to surround, a portion of the control unit. Preferably also the special locking disc is separated from the portion of the control unit which it surrounds by a guiding disc which is non-turnably supported to the lock cylinder. Hereby it is impossible to affect or reach the special locking disc through the key channel.

Conveniently the guiding disc forms part of the guiding groove so that when the coupling member is moved into its coupling position the guiding groove limits the turning movement of the coupling member and thus defines the coupling position of the coupling member. Such a construction requires little space and is advantageous to manufacture.

By providing the control unit with a radial protrusion, which is arranged to return the special locking disc into its original position when the lock is being locked again after opening of the locking mechanism, the return movement of the special locking disc is secured in a simple way.

One advantageous embodiment of the invention relates to a cylinder lock having a lock cylinder which includes an axial slot and which is provided with a set of locking discs mechanically turnable with the key of the lock, the locking discs being located inside the lock cylinder and each being provided with a peripheral notch together determining the opening combination of the lock. In addition the locking means include a locking bar which in its locking position together with the locking discs prevents turning of the lock cylinder with regard to the lock body and which is movable into its releasing position allowing said turning by first turning the locking discs with the key into a position in which their peripheral notches form a uniform channel at the position of the locking bar and said slot in the lock cylinder. In this case the special locking disc may with advantage be functionally connected to the locking bar so that it determines movement of the Locking bar between the locking and releasing positions independent of the other locking discs. In this case no separate blocking member for the special locking disc is required. In this embodiment the control unit operates with advantage as a lifting 0-locking disc, whereby it ensures that the locking bar is smoothly returned to its locking position.

Security of the locking may further be improved so that the turning movement of the special locking disc into its position for releasing the locking mechanism is arranged to reach the end of its travel before the conventional locking discs of the lock mechanism reach their releasing positions. In this case the guiding disc may with advantage be arranged to guide the coupling member when turned into its coupling position until the key reaches the turning position in which the special locking disc is moved into its releasing position. In addition the guiding disc may with advantage include a notch which allows turning of the coupling member into its non-coupling position after the special locking disc has reached its releasing position, whereby when the key is moved further the key simultaneously arranges the other locking discs into their respective releasing positions.

In practice the turning of the coupling member into its non-coupling position is arranged by means of the guiding surface of the special locking disc.

BRIEF DESCRIPTION OF THE DRAWINGS

Embodiments of the invention will now be described, by way of example only, with particular reference to the accompanying drawings, in which:

FIG. 1 is a sectional view of an electromechanical cylinder lock-key-combination according to the invention, the section being taken in the longitudinal direction of the lock;

FIG. 2 is a sectional view taken on the line II—II of FIG. 1;

FIGS. 3–5 show the cylinder lock of FIG. 2 in different operating positions.

DETAILED DESCRIPTION

Figure 4:
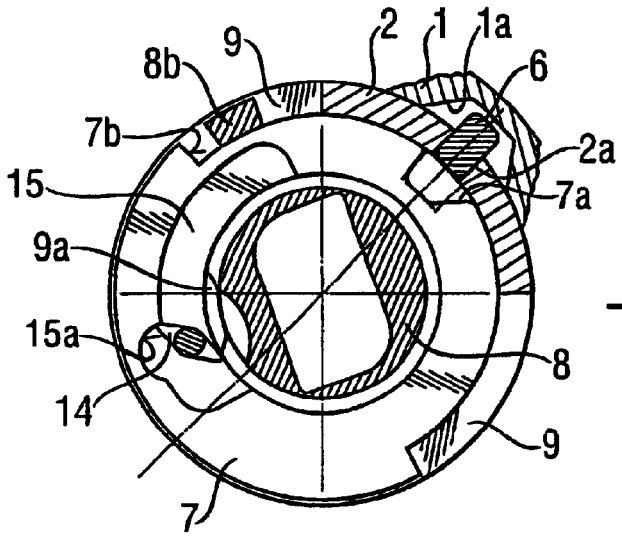

In the drawings reference numeral 1 designates a lock body enclosing a lock cylinder 2 and a locking bar 6 which, in its locking position, is located partly in a groove 1*a* in an inner surface of the lock body 1 and partly in a slot 2*a* in the lock cylinder 2. In the locking position of the locking bar 6 turning of the lock cylinder 2 relative to the lock body 1 is prevented. Positioned inside the lock cylinder 2 is a set of discs which includes a number of locking discs 3, each provided with a peripheral notch 3*a*, and intermediate discs 4 separating the locking discs. The locking discs 3 can be turned in a manner known as such by utilising a "mechanical code" formed in a shank 5*a* of a key 5, the "mechanical code" being provided by combination surfaces cut in the key shank and which are not shown in detail in the drawings. The key 5 is thus able to turn the locking discs into a position opening the lock, in which the peripheral notches 3*a* are arranged at the position of the slot 2*a* of the lock cylinder and the locking bar 6 so that they form a uniform channel into which the locking bar 6 can enter thereby releasing the lock cylinder 2 to turn relative to the lock body 1.

The key 5 of the lock includes means 16 for storing an "electronic code" and for supplying it via contact means 17 to the lock. The key is preferably also provided with a power source, for instance a battery (not shown), so that electrical power can be supplied from the key into the lock for operation of electronics and electric operating means located in the lock. With such an arrangement there is no need for the lock itself to be provided with a power source or to be connected to an external power source via electric cables.

In addition the lock body 1 is provided with a special locking disc 7 which is provided with a guiding groove 15 having a guiding surface 15*a*. The special locking disc 7 is separated by means of a guiding disc 9 from the other locking discs 3 and from a control unit 8 which is continuously turnable with the key when the key is turned in the lock. The guiding disc 9 is non-turnably supported to the lock cylinder 2 and its outer surface forms with the guiding surface 15*a* the guiding groove 15. The control unit 8 includes a contact member 11, which is in cooperation with contact means 17 of the key when the key is in the lock, identification and control means 12 and electric operating means 13 to which a turnable coupling member 14 is attached. The control unit 8 is provided with a cover element 8*a*. In addition the lock body 1 includes a plate element 10 which serves as a protection against drilling and which can additionally be utilised as a profile disc for determining profile forms of key shanks compatible with the lock in order to provide different key families.

The control unit 8 is only partly located inside the lock cylinder 2, whereby its diameter outside the lock cylinder may be correspondingly wider so that it is easier to incorporate said separate devices and means therein. On the other hand, since the control unit 8 is partly located inside the lock cylinder 2, it forms for its part, together with the special locking disc 7, a mechanism affecting the movements of the locking bar 6. For this purpose the locking bar 6 is arranged to extend as far with regard to the control unit 8 as the lock cylinder 2. In this case the special locking disc 7 is provided with a peripheral notch 7*a* for the locking bar 6 and the control unit 8 is arranged to include an axial groove (not shown) corresponding to the peripheral notch and extending as far over the control unit 8 as the locking bar 6. Thus, since the control unit 8 is always turned with the key when the key is turned in the lock, the peripheral groove in the control unit 8 can be utilised quite in the same way as the so-called "lifting 0-locking disc" which is generally used in lock mechanisms with rotatable locking discs and which secures smooth movement of the locking bar back into its locking position inside the groove 1*a* in the lock body when the lock mechanism is locked.

In FIG. 2 the lock is shown in its locked position with the coupling member 14 located in the guiding groove 15 of the special locking disc 7. Since in this position the peripheral notch 7*a* is not located at the position of the locking bar 6, the special locking disc 7 prevents movement of the locking bar 6 into its releasing position independently of the positions of the other locking discs. Naturally, in this position also the other locking discs 3 are "scrambled", whereby their peripheral notches (not shown in FIG. 2) are each located in a turning position corresponding to their selected combination values so that also the locking discs 3 correspondingly prevent movement of the locking bar 6 into its releasing position.

When an electronic code is supplied from the key via the members 17 and 11 into the identification and control means 12 of the control unit 8, the electronic code is compared with a prestored code or codes. If the electronic code is correct the means 12 activate the electric operating means 13 so that the coupling member 14 is turned about its axis into the position shown in FIG. 3. In this case the coupling member 14 has moved against the outer surface of the guiding disc 9, which thus determines the turning position of the coupling member 14. When the key is now turned in the lock the control unit 8 and at the same time the coupling member 14 are turned with the key, whereby the coupling member 14 hits or coacts with the guiding surface 15*a* in the guiding groove 15. As a consequence of the coupling member affecting the guiding surface in this manner the special locking disc 7 starts turning with the key 5, control unit 8 and the coupling member 14 and continues until the situation of Figure 4 is reached. In FIG. 4 the peripheral notch 7*a* of the special locking disc 7 has turned to the position of the locking bar 6 and thus the special locking disc 7 is in its releasing position.

Figure 5:
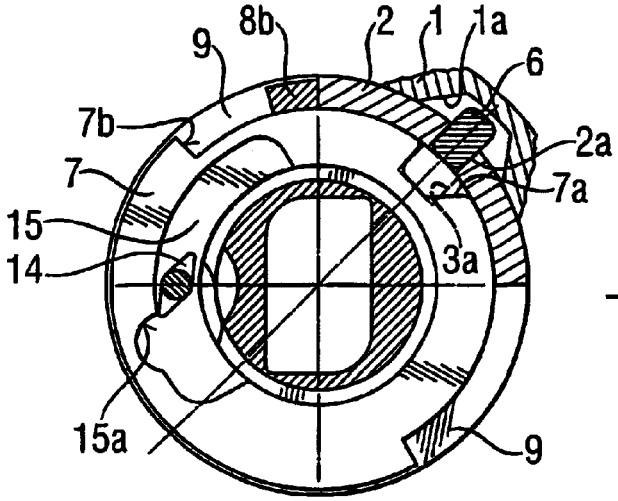

In order to improve the locking security the turning of the special locking disc 7 into its releasing position has been arranged to take place by a selecting movement, which is shorter than the selecting movement needed to arrange the other locking discs 3 correspondingly. Thus, turning of the key has to be further continued in order to arrange the other locking discs 3 into their releasing positions. For this purpose the guiding disc 9 includes a notch 9*a* bounding the guiding groove 15 which, in the situation of FIG. 4, makes it possible to turn the coupling member 14, under the influence of the guiding surface 15*a*, about its axis into the position of FIG. 5 at the same time as the control unit 8 itself is turned by means of the key. As a consequence of this turning movement the other locking discs are also turned into their respective releasing positions so that the peripheral notches of all the locking discs are arranged at the position of the locking bar 6 in accordance with FIG. 5, whereby the lock mechanism is opened.

Returning of the locking discs into their original positions to lock the lock mechanism is carried out by turning the key in the opposite direction. The conventional locking discs may be returned in a known way depending on the type of the lock mechanism. This may take place directly by contact with the key or, for instance, in accordance with the arrangement disclosed in EP-A-0943763 by making use of a return bar installed in the key channel of the lock, for the part of the operation of which as such reference is made to the publication EP-B-0617184. Since there is no direct force transmission connection between the key and the special locking disc 7, its return movement is carried out by a radial protrusion 8*b* in the control unit 8 acting on a step-like counter surface 7*b* in the periphery of the special locking disc 7.

Figure 6:
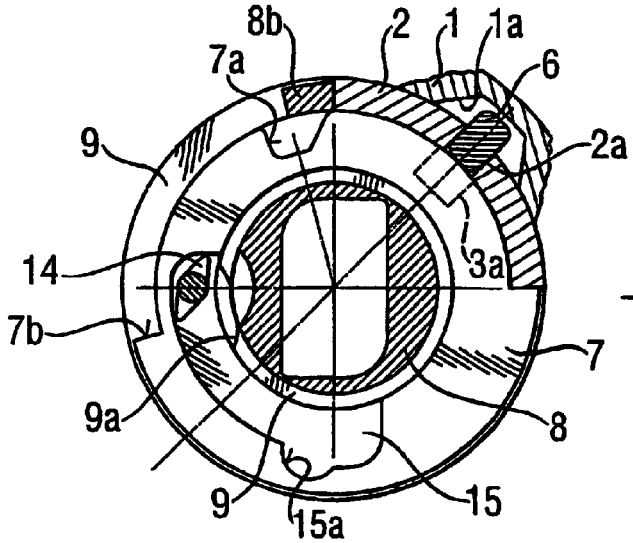
FIG. 6 shows the cylinder lock of FIG. 2 after turning of the key when a sent electronic code is incorrect.

FIG. 6 shows what happens when a key is turned in the lock if the electronic code supplied is incorrect. In this case the coupling member 14 remains in its original position (shown in FIG. 2), whereby when the control unit 8 is turned by the key the coupling member 14 does not hit the guiding surface 15*a* in the guiding groove 15 of the special locking disc 7 and thus the special locking disc 7 is not turned at all. In order to make turning of the key possible also in this situation the guiding groove 15 is designed so as to allow turning of the coupling member 14 together with the key, as is apparent from FIG. 6.

Since in addition to the operation of the electronic components there is only a momentary need of power to turn the coupling member 14 into its coupling position (cf. FIGS. 2 and 3), there is no need to provide the lock body with a power source of its own since the power can be supplied via the key, e.g. by means of a battery carried by the key. The electric operation devices 13 comprise with advantage a small electric motor or a solenoid.

The preferred embodiment of the invention described above is based on a basic lock mechanism provided with turnable or rotatable locking discs, whereby the same locking bar can be utilized both for the conventional locking discs 3 and for the special locking disc 7 as described. The solution according to invention, however, is not limited to embodiments based on different locking discs, but it can be applied also to lock mechanisms of other kinds such as pin tumbler mechanisms. Then, however, the lock body should be provided with a separate locking bar or the like member, if not otherwise provided for, which is in cooperation with the special locking disc 7 and the control unit 8.

Thus the invention is not limited to the embodiment disclosed, but several modifications are feasible within the scope of the attached claims.

What is claimed is:

1. An electromechanical cylinder lock-key-combination comprising:

a key that is insertable in the lock and is turnable in the lock, the key having a mechanical locking code and including a means for storing an electronic code and for transmitting the electronic code to the lock, a lock body, a turnable lock cylinder enclosed by the lock body, a locking means enclosed by the lock body and which normally prevents turning of the lock cylinder relative to the lock body and which can be moved by means of the key to a releasing position allowing turning of the lock cylinder relative to the lock body in response to turning of the key in the lock, at least one special locking disc enclosed by the lock body and with which the key is not in direct mechanical force transmission connection when the key is inserted in the lock, the special locking disc being formed with a guiding groove having a guiding surface and the special locking disc having a locking position in which it prevents turning of the lock cylinder relative to the lock body and also having a releasing position, an identification and control means for receiving and identifying the electronic code transmitted from the key, an electric operating means, and a turnable coupling member attached to the electric operating means and having a free position and a coupling position, whereby when there is a match with the electronic code of the key, said identification and control means activates said electric operating means to turn said coupling member to its coupling position, in which the coupling member engages the guiding surface and thereby couples said at least one special locking disc with turning movement of the key for opening the lock.

2. A combination according to claim 1, wherein the guiding groove is configured so that in the free position of the coupling member, the coupling member allows turning movement of the key and the coupling member relative to the special locking disc.

3. A combination according to claim 1, wherein the lock includes a control unit into which the key is insertable and which turns continuously with the key when the key is turned in the lock, and the coupling member is attached to the control unit whereby the coupling member turns with the key when the key turns in the lock.

4. A combination according to claim 3, wherein the electric operating means is mounted in the control unit.

5. A combination according to claim 3, wherein the identification and control means is mounted in the control unit.

6. A combination according to claim 3, wherein the special locking disc is located inside the lock cylinder, axially between the locking means and the control unit, is positioned radially outward of a portion of the control unit and surrounds said portion of the control unit, and is separated from said portion of the control unit by a guiding disc which is non-turnably supported relative to the lock cylinder.

7. A combination according to claim 6, wherein the guiding disc has a surface that bounds the guiding groove so that when the coupling member is turned to its coupling position said surface of the guiding disc limits the turning movement of the coupling member and thus defines the coupling position of the coupling member.

8. A combination according to claim 3, wherein the special locking disc turns in a first direction from its locking position to its releasing position for opening the lock and the control unit includes a radial protrusion that engages the special locking disc when the control unit is turned in a second direction, opposite said first direction, after opening of the lock for returning the special locking disc from its releasing position to its locking position.

9. A combination according to claim 1, wherein the lock cylinder includes an axial slot, the locking means comprises a set of locking discs that are located inside the lock cylinder, each locking disc of the locking means is provided with a peripheral notch, the locking means further includes a locking bar which has a locking position in which the locking discs of the locking means and the locking bar together prevent turning of the lock cylinder relative to the lock body, the locking bar has a releasing position in which it permits turning of the lock cylinder relative to the lock body, the locking discs of the locking means prevent the locking bar from moving from its locking position to its releasing position unless the locking discs of the locking means are positioned so that the peripheral notches of the locking discs form a uniform channel at the position of the slot in the lock cylinder, and the special locking disc is functionally connected with the locking bar so that it prevents movement of the locking bar from the releasing position to the locking position independently of the locking discs of the locking means.

10. A combination according to claim 9, wherein the lock includes a control unit into which the key is insertable and which turns continuously with the key when the key is turned in the lock, and the control unit has a surface for urging the locking bar to its locking position when the key turns the control unit from a releasing position of the control unit towards a locking position of the control unit.

11. A combination according to claim 10, wherein upon turning the key for turning the locking discs to the respective releasing positions, the special locking disc reaches its releasing position before the locking discs of the locking means reach their releasing positions.

12. A combination according to claim 11, wherein the special locking disc is located inside the lock cylinder, axially between the locking means and the control unit, and is separated from the control unit by a guiding disc which is non-turnably supported relative to the lock cylinder, the guiding disc has a surface that bounds the guiding groove so that when the coupling member is turned to its coupling position said surface of the guiding disc limits the turning movement of the coupling member upon turning the key in a direction for turning the locking discs to the respective releasing positions, the surface of the guiding disc guides the coupling member until the special locking disc reaches its releasing positions and the guiding disc includes a notch that allows turning of the coupling member to its free position whereby the key can turn relative to the special locking disc in said direction for turning the locking discs to their respective releasing positions after the special locking disc has reached its releasing position.

13. A combination according to claim 12, wherein turning of the coupling member from its coupling position to its free position is effected by engagement of the coupling member with said guiding surface of the guiding groove.

14. A combination according to claim 1, wherein the guiding surface of the guiding groove is disposed substantially radially with respect to the lock cylinder, the turnable coupling member is turnable about an axis that is substantially parallel to the turning axis of the lock cylinder, the coupling member has an end that is spaced radially from the axis of turning movement of the coupling member, in the free position of the coupling member the end of the coupling member is radially inward of said guiding surface relative to the lock cylinder and the coupling member does not engage the guiding surface upon turning movement of the key for opening the lock, and upon turning the coupling member to the coupling position, the end of the coupling member moves from the radially inward position to a radially outward position relative to the lock cylinder and engages the guiding surface upon turning movement of the key for opening the lock.

15. A combination according to claim 1, wherein the lock cylinder includes an axial slot, the locking means comprises a locking bar which has a locking position in which it prevents turning of the lock cylinder relative to the lock body, and the special locking disc has a peripheral notch and is turnable in the lock cylinder to a position in which the peripheral notch can receive the locking bar and allow movement of the locking bar from its locking position to a releasing position in which the locking bar allows turning of the lock cylinder.

* * * * *